United States Patent [19]

Manwaring

[11] 4,149,814

[45] Apr. 17, 1979

[54] FOUNTAIN BRUSH LIQUID APPLICATOR

[75] Inventor: William F. Manwaring, Chadds Ford, Pa.

[73] Assignee: E. I. du Pont De Nemours and Company, Wilmington, Del.

[21] Appl. No.: 808,397

[22] Filed: Jun. 20, 1977

[51] Int. Cl.[2] ..... B05C 1/06; A46B 11/02; B43M 11/06

[52] U.S. Cl. ..... 401/186; 401/160; 401/155; 401/183; 401/162; 401/269; 401/206

[58] Field of Search ..... 401/183, 186, 155, 160, 401/162, 169, 165, 167, 158, 159, 269, 205, 206

[56] References Cited

U.S. PATENT DOCUMENTS

| | | | |
|---|---|---|---|
| 1,400,954 | 12/1921 | Holloway et al. | 401/155 |
| 2,976,560 | 3/1961 | Turner | 401/186 |
| 3,038,193 | 6/1962 | Luedtke et al. | 401/206 |
| 3,075,229 | 1/1963 | Rufo | 401/186 |
| 3,181,539 | 5/1965 | Aston | 401/198 |
| 3,372,426 | 3/1968 | Schwartzman | 401/183 |
| 3,390,940 | 7/1968 | Schwartzman | 401/186 |
| 3,545,874 | 12/1970 | Schwartzman | 401/186 |
| 3,896,822 | 7/1975 | Zimmerman | 401/186 |
| 4,040,753 | 8/1977 | Griffith | 401/186 |

FOREIGN PATENT DOCUMENTS

| | | | |
|---|---|---|---|
| 628272 | 10/1927 | France | 401/169 |
| 717419 | 10/1954 | United Kingdom | 401/169 |

*Primary Examiner*—William Pieprz

[57] ABSTRACT

A pen shaped device includes a brush-type applicating tip for dispensing and applying liquid that is stored in an integral fountain reservoir bag. The brush is permanently mounted outside the reservoir, receiving liquid through a hollow tube or other narrow passage. A check valve is provided within the device to prevent leakage during storage but the valve allows liquid to pass from the reservoir to the brush under the impetus of semi-automatic or manual finger-operable feed control. The brush is kept moist during storage by being capped in an air-tight enclosure which receives vapor of the liquid through a vapor-permeable membrane communicating with the reservoir.

3 Claims, 8 Drawing Figures

FOUNTAIN BRUSH LIQUID APPLICATOR

BACKGROUND OF THE INVENTION

1. Field of the Invention

This invention is related to a self-contained liquid application-storage device and in particular to a device which is hand held and provides leak-proof, finger-controllable feed to an applicator brush.

2. Description of the Prior Art

Liquid applicators have been in various forms, the most common being assemblies using a brush for actual application. Brush-type applicators have had disadvantages during storage and use.

The conventional brush-type liquid dispensers have been in the form of a small container with a screw cap to which a brush assembly is attached. During storage, the brush is immersed in the liquid in the container. In use, the cap is unscrewed and the brush, wet with the liquid and often dripping, is removed. Application requires two hands, the reservoir and applicator being separate units, and is often messy since there is no way to control the amount of liquid on the brush except to wipe off the excess.

Liquid dispensers have been developed in which a closed liquid fountain or liquid reservoir and a brush applicator are integrated into one unit.

U.S. Pat. No. 2,932,046 issued Apr. 12, 1960 to B. Skolnikoff shows a fountain-applicator device with which liquid is applied by a brush. The brush is retractable such that during storage, it is housed within the tip of the device but not within the reservoir itself. No provision is made for keeping the brush moist and the brush tends to dry and stiffen during periods of non-use. In use, the brush is extended beyond the tip and liquid flows to it by gravity. No control of the feed is provided so there is consequently a possibility that either too little or too much liquid will reach the brush for the desired application.

Another gravity-fed reservoir-applicator is disclosed in U.S. Pat. No. 3,035,299, issued May 22, 1962 to W. Gordon, et al. The liquid is applied by a retractable brush which, during use, is extended from its storage enclosure. Feed is by gravity but some metering of the flow is accomplished by mounting the brush in an extension of the reservoir in such a way that applicative wiping pressure upon the brush unseats a valve connected to the brush and allows a quantity of liquid to pass to it from the reservoir. This assembly prevents dripping but is not precise in controlling liquid flow during application.

The use of positive feed to an applicator brush from an integral reservoir is known and was shown, for example, in U.S. Pat. No. 3,359,992, issued Dec. 26, 1967 to F. Cishek, et al. In the device shown in this patent, liquid is force-fed from a reservoir through a tube to a brush applicator by a screw-actuated plunger. The brush applicator is retractable for storage. However, there is no mechanism to keep the brush moist during storage and this can cause the brush to stiffen as liquid residue on the brush dries.

U.S. Pat. No. 2,611,915, issued Sept. 30, 1952 to L. Prokop et al. and U.S. pat. No. 2,682,070, issued June 29, 1954 to H. LeMoine also disclose fountain-type applicators which have brush tips and non-gravity liquid feed. In these devices, some control over the supply of liquid to the brush is provided but precise control is unavailable.

The prior art, as exemplified above and as it relates to self-contained fountain type liquid applicators, has an unfulfilled need for applicators which offer both easily operable accurate control of liquid supply to an integral brush and a method for maintaining brush softness during storage.

SUMMARY OF THE INVENTION

According to the present invention, a liquid storage-applicator device is provided which has a permanently mounted brush in combination with an elongate fluid reservoir in the form of a bag.

A check valve, contained in a housing which is between the reservoir and the brush, is provided to pass liquid from the reservoir, through the housing to the brush, only when positive expelling force is applied to the reservoir. It is contemplated that the positive feed be effected in any conventional manner.

A brush is mounted in such a manner so as to be in fluid communication with the interior of the valve housing.

There is also provided in the device of this invention means for keeping the brush soft during storage by covering it with a vapor impermeable cap which forms an air-tight enclosure around the brush. This enclosure communicates with a vapor permeable membrane in contact with the stored liquid, thereby supplying vapor of the liquid to this enclosure which hinders evaporation of any liquid residue on the brush.

Accordingly, the liquid applicator device of this invention provides non-drip storage and accurate liquid flow control through operation of the check valve in conjunction with the reservoir bag which lends itself to any mode of positive liquid feed therefrom.

BRIEF DESCRIPTION OF THE DRAWINGS

FIG. 5 is a front elevation of the completely removable sheath and cap which encase the applicator during storage.

FIG. 6 is a partial front elevation, in section, of the applicator, completely removed from the storage sheath and cap.

DETAILED DESCRIPTION OF THE INVENTION

For convenience, the positions of the devices in FIGS. 1, 2, 5-8 are defined as their upright positions and the devices will be described with the location of the parts designated as they appear when the devices are upright.

Referring to FIGS. 1-4, there is shown an applicator according to one embodiment of this invention which comprises a tubular outer casing 1 having a longitudinal slot 7 and a circular aperture 31 centrally positioned in the lower end wall.

Figure 1:
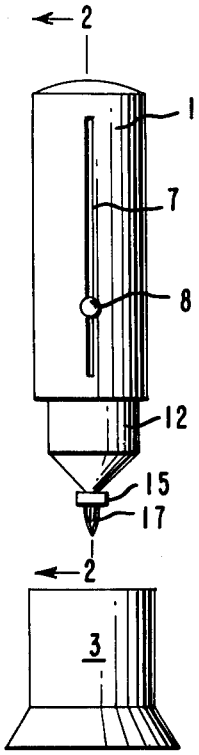
FIG. 1 is a front elevation of an applicator according to one embodiment of this invention showing it in its upright position with the storage cap removed.
Figure 2:
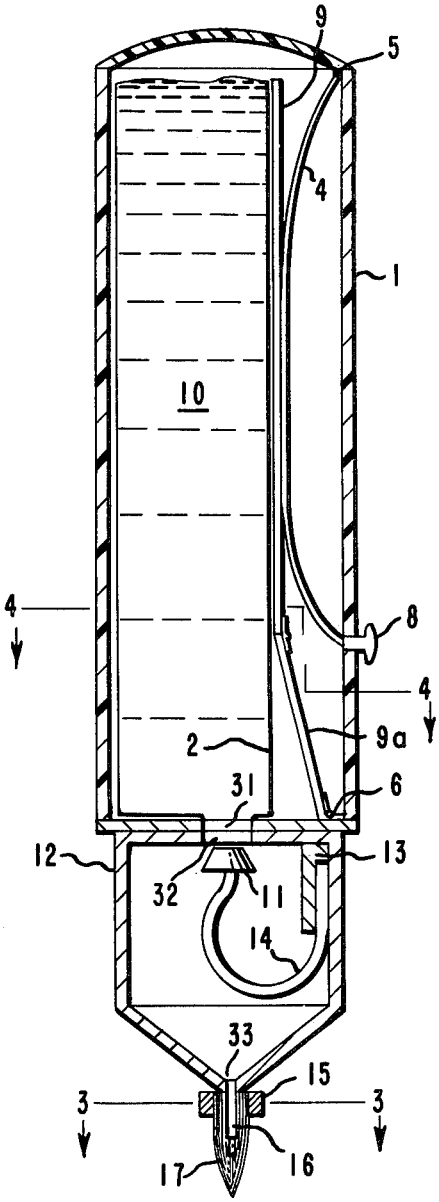
FIG. 2 is an enlarged sectional front elevation on the line 2—2 of FIG. 1.
Figure 3:
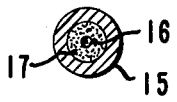
FIG. 3 is a sectional end elevation of the applicator on line 3—3 of FIG. 2 showing details of the brush mounting.
Figure 4:
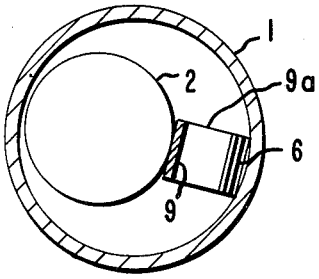
FIG. 4 is a sectional end elevation on line 4—4 of FIG. 2.

A flexible, collapsible reservoir bag 2 is located within the tubular casing 1. The bag is tubular in shape when full of liquid 10 as shown in FIG. 2. The bag has a circular opening at its lower end of substantially the same diameter as the aperture 31 in the casing 1, and is permanently fixed to the casing along the rim of this opening, such that the opening and the aperture 31 coincide.

Also located within the casing 1 is a rigid bar 9 which abuts the bag 2. The bar 9 is connected by a hinge to a rigid extension 9*a* which, in turn, is pivotally connected by hinge 6 to the interior of the lower end wall of the casing 1.

The assembly formed by the bar 9 and the extension 9*a* is pressed against the bag 2 to provide the non-gravity positive expelling force to feed the liquid 10 from the reservoir bag 2. The feed is controlled by finger-sliding a friction-set control knob 8 along the barrel of the casing within the slot 7. This controls the arc in a pre-tensioned longitudinal spring 4 which, in turn, forces the bar 9 against the bag 2, pressurizing it and forcing liquid therefrom. The spring 4 is fixed at one end to the control knob 8 which partially protrudes through the slot 7 into the interior of the casing 1. The other end of the spring 4 is pivotally mounted at or near the top interior of the casing 1 by a hinge 5.

The casing 1 is permanently attached at its lower end to the top wall of a hollow housing 12. The housing has a circular inlet opening 32 in its top wall and a smaller circular outlet opening 33 at the tip of its downwardly-pointing conically-shaped lower portion as shown in FIG. 2. The casing 1 and housing 12 are attached such that the aperture 31 and the opening 32 are aligned.

Within the housing is a check valve 11 which is constructed of a vapor permeable material such as, for example, polyethylene or porous Teflon®. The valve 11 is mounted at the end of a resilient spring 14 which, in turn, is fixed within the housing by a clamp 13. The valve 11 is normally pressed upward by the spring 14 and is seated on the inner circular ledge of the opening 32. In this position, the valve 11 completely seals the opening 32 and prevents flow of the liquid 10 downward from the bag 2 to the interior of the housing 12 through aperture 31 and opening 32.

The valve 11 is unseated when the bag 2 is placed under feed pressure, forcing some liquid from the bag 2 through aperture 31 and opening 32. The strength of the spring 14 preferably is adjusted so that the valve 11 will not be unseated unless the pressure differential between the interior of the bag 2 and the interior of the housing 12 exceeds that resulting merely from liquid head plus vapor pressure of the liquid in the bag.

A hollow tube 16 is press fitted into a housing 12 at the outlet opening 33. The tube 16 is set flush at its upper end within the opening 33 and is extended downwardly. A ferrule 15 is fixed about the tube 16 at its extension from the housing 12. A plurality of bristle defining a brush 17 extend from within the ferrule to an exposed position. The tube 16 can be centrally positioned within the bristles with its lower end terminating in the interior portion of the brush located beyond the ferrule as shown. The brush is mounted tightly about the exterior of the tube by the ferrule. The tube thus provides fluid communication between the interior of the housing and the interior of the brush.

The interior passage of the tube 16 is preferably sufficiently long and narrow to retain liquid therein against tendency to flow by gravity alone. This, in conjunction with the check valve 11, prevents passage of liquid to the brush in the absence of positive expelling force.

While a hollow tube is shown as being preferred in this and in the two succeeding embodiments, other means for providing a narrow fluid passage to the brush can also be used. Alternatively, for example, the conically shaped lower portion of housing 12 can be solid but with a narrow diameter bore through its right axis. In such a case, the lower portion of housing 12 can be shaped such that this bore is of sufficiently small size to retain liquid in the housing against tendency to flow by gravity. The brush can be mounted at the discharge end of this bore in any convenient manner.

Another variation is one in which no passage from the housing is used at all. In such a case, the brush can be mounted directly, by force fit or otherwise, in the outlet opening of housing 12. The small outlet opening being substantially filled by the brush bristles prevents liquid from dripping down the brush from housing 12 unless positive expelling force is applied to force liquid from the housing through the brush bristles.

To apply liquid with the hand-holdable applicator of the embodiment shown in FIG. 2, the control knob 8 is moved by the fingers, along the slot 7, accentuating the arc in spring 14 which presses the bar 9 against the bag 2. The bag is thus pressurized.

The excess pressure in the bag causes the valve 11 to unseat and an amount of liquid is expelled through the housing 12 and to the brush 17 through tube 16. When the excess pressure is relieved, by the release of liquid, valve 11 is reseated, sealing opening 32 to prevent the passage of any more liquid.

For storage purposes, a vapor impermeable cap 3 is fit over the exposed brush. The cap is long enough to contact a lower portion of the barrel of casing 1 in a friction-fit coupling. This provides a substantially air-tight vapor space about the brush 17. Vapors from the liquid 10 stored in bag 2 permeate valve 11 and have access to brush 17 through tube 16. When the brush is contacted with vapor in this manner, evaporation of any liquid residue on the brush, which tends to stiffen the brush, is substantially prevented. Permeation of valve 11 by these vapors also substantially prevents the drying and subsequent caking of liquid residue in housing 12 or tube 16.

Figure 5:
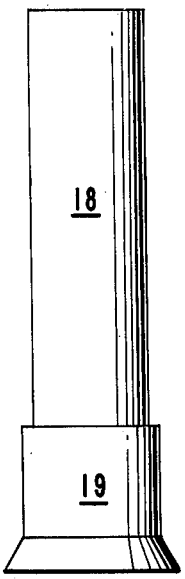
FIGS. 5-6 show another embodiment of the invention.
Figure 6:
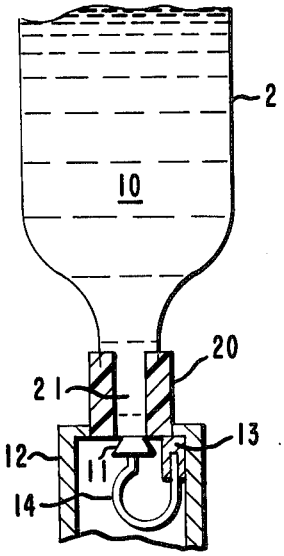

FIGS. 5 and 6 show an applicator according to another embodiment of this invention.

Referring to FIG. 6, liquid 10 is stored in a flexible, collapsible reservor bag 2 constructed of a vapor-permeable material. The bag 2 is tapered at its forward end to a circular opening. The bag is sealed to a rigid cylindrically shaped neck 20 having a pasageway 21 through which liquid 10 can flow from the bag.

The neck 20 is attached at its lower end to a rigid, hollow housing 12. The housing 12 has a circular opening in its top wall into which the neck 20 is permanently fitted. Alternatively, the housing 12 and neck 20 can be integral.

Within the housing 12 is a check valve 11 mounted at the end of a resilient curved spring 14 which, in turn, is fixed within the housing by clamp 13. The valve 11 is normally pressed upward by the spring 14 and is seated on the inner circular edge of the neck 20. In this position, the valve 11 completely seals the mouth of passageway 12 and prevents flow of liquid 10 downward from the bag to the interior of the housing 12.

This embodiment is otherwise substantially similar to the first enbodiment, shown in FIGS. 1–4 and described above, with respect to the portion of the device encompassing the lower portion of the housing 12 and the brush 17, tube 16, and ferrule 15.

To apply liquid with the applicator of this second embodiment, the device can be held in one hand and the reservoir bag 2 squeezed and collapsed with the fingers, similar to the manner in which a tube of toothpaste is squeezed.

The excess pressure in the bag 2, caused by the squeezing, unseats the valve 11 and an amount of liquid 10, sufficient to relieve the excess pressure, is expelled through the housing 12 to the brush 17 through tube 16. When the excess pressure is relieved, valve 11 reseats, sealing passageway 21 to prevent the flow of any more liquid.

When the applicator of this embodiment is to be stored, it is placed in a tubular vapor impermeable sheath 18 which is open at one end. A vapor impermeable cap 19 is friction-fit over the open end of sheath 18, providing a substantially air-tight encapsulation of the entire applicator. Vapors from the liquid 10 stored in bag 2 permeate the bag and contact the brush 17 when it is enclosed during storage.

Figure 7:
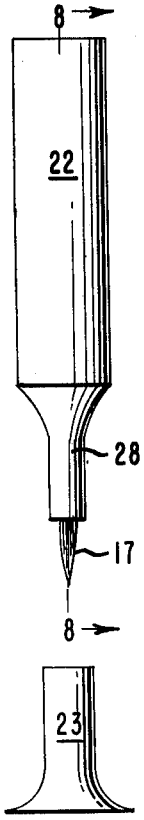
FIG. 7 is a front elevation of a third embodiment of this invention showing it in its upright position with the storage cap removed.
Figure 8:
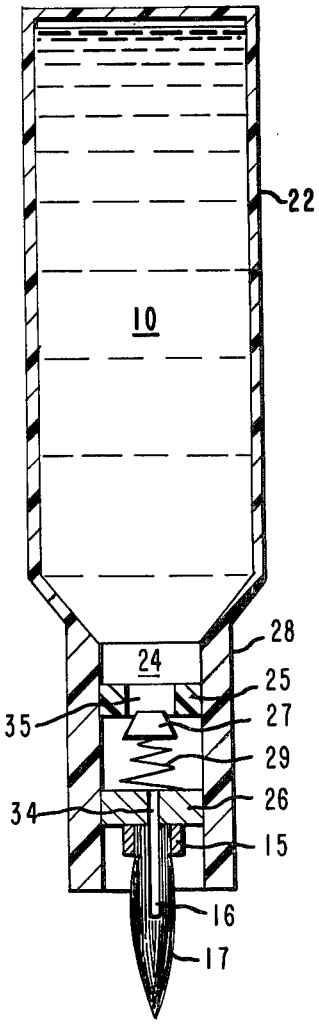
FIG. 8 is an enlarged sectional front elevation on the line 8—8 of FIG. 7.

According to a third embodiment of this invention, shown in FIGS. 7 and 8, liquid 10 is stored in a flexible, resilient, bottle shaped bag 22 having an integral, cylindrically-shaped neck 28 with a passage 24. Neck 28 can be of the same material as bag 22, in such a case, its walls are thicker such that, while the bag is flexible, the neck is substantially rigid. Bag 22 is tapered to an opening corresponding to the beginning of passage 24 at the confluence of bag 22 and neck 28.

Mounted within neck 28, recessed from its open end, is an annularly shaped plug 26 having an aperture 34. Similarly mounted in neck 28, between plug 26 and the opening of bag 22, is an annularly shaped bushing 25 having an aperture 35.

A check valve 27, constructed of vapor-permeable material, is mounted on a helical spring 29 which in turn is attached to plug 26. The valve 27 is mounted such that it is normally pressed upwardly by the spring 29 and is seated on the lower rim of aperture 35 of bushing 25. In this position, valve 11 completely seals the lower end of aperture 35 and prevents flow of liquid from bag 22 beyond bushing 25. As with the first and second embodiments shown above, the strength of spring 29 preferably is adjusted so that valve 27 will not unseat, absent a pressure differential in excess of that resulting merely from liquid head plus vapor pressure of the liquid in the bag.

A hollow tube 16 is press fitted into the aperture 34 of plug 26. The tube 16 is extended downwardly from plug 26, preferably beyond neck 28. A ferrule 15 is fixed about tube 16 below plug 26. A plurality of bristles determining brush 17 extend from within the ferrule to an exposed position. The tube 16 can be centrally positioned within the bristles, similar to the positions shown in FIG. 3 of the first embodiment of the invention, with its lower end terminating in the interior portion thereof located beyond the ferrule 15. The brush 17 is mounted tightly about tube 16 by the ferrule 15. The tube thus provides fluid communication between the interior of brush 17 and the interior of neck 28.

Preferably, the interior passage of tube 16 is sufficiently long and narrow to retain liquid therein against tendency to flow by gravity alone. This decreases the likelihood of dripping.

Application of liquid 10 is effected by squeezing bag 22 with fingers. The finger pressure on the resilient bag 22 creates excess pressure therein, unseating valve 27 to relieve the pressure by allowing an amount of liquid to be fed to brush 17 through tube 16.

With the excess pressure relieved, valve 27 is reseated by spring 29, preventing passage of any more liquid beyond bushing 25. The resilient reservoir bag 22 returns to its original shape when finger pressure is released, sucking air into the reservoir through vapor-permeable valve 27, which is also permeable to air.

During storage, a vapor impermeable cap 23 is fitted over the dispensing end of the applicator, engaging the exterior of neck 28 in a friction-fit coupling, providing a substantially air-tight enclosure around brush 17. Vapors from liquid 10 stored in the reservoir bag 22 permeate valve 27 and have access to the brush through tube 16. Contacting the brush with these vapors maintains brush softness.

The vapor permeability need not be restricted to valve 27. For example, the valve can be vapor impermeable in which case bushing 25 is constructed of a vapor permeable material. The invention comprehends similar designs which provide vapor access, through a vapor permeable membrane, to the brush during storage.

What is claimed is:

1. An apparatus for storing and applying liquids to a surface comprising:

a closed tubular casing having an aperture in one end wall and a longitudinal slot;

a flexible collapsible bag which is tubular in shape when full and which has a circular opening at one end, this end being inwardly tapered so that the opening is of smaller diameter than said bag, said bag being situated within said casing and being attached at its opening to the aperture in said casing, providing a fluid passage from said bag through the aperture;

a rigid bar abutting said bag and being movably mounted in said casing such that movement of said bar causes it to press said bag;

a control knob inserted in the slot in said casing, said knob being finger-slidable the length of the slot;

means for pressing said bar against said bag, said means being situated within said casing and attached to said control knob through the slot such that sliding said knob actuates said means;

a rigid hollow housing having a circular inlet opening and a smaller circular outlet opening longitudinally coaxially to each other, said housing being rigidly fixed to the outside of the apertured end wall of said casing such that a fluid passage through the aperture is provided between the opening in said bag and the inlet opening in said housing;

a check valve of vapor-permeable material, situated within said housing, which is normally urged into a position such that the inlet opening of said housing is closed off to prevent passage of liquid from said bag into said housing, said check valve being displaceable to an open position to allow passage of liquid through the inlet opening when said bar is pressed against said bag;

a hollow tube, open at both ends, which is attached at one end within the outlet opening of said housing so that the passageway of said tube is in fluid communication with the interior of said housing, said tube extending longitudnally from said housing and said tube being sufficiently long and its passageway being sufficiently narrow to retain liquid therein against tendency to flow therethrough by gravity along;

a brush mounted tightly around the extended end of said tube such that said tube connects the interior of said housing with an interior portion of said brush; and a rigid vapor-impermeable cap which is removably fit over said brush and which is sufficiently long to engage the exterior of said casing in a friction-fit air-tight coupling, thereby forming an air-tight enclosure about said brush.

2. An apparatus for storing and applying liquids to a surface comprising:

a flexible resilient bag which is tubular in shape and which has a circular opening at one end, this end being inwardly tapered whereby the opening is of smaller diameter than said bag;

a rigid neck integral with said bag and extending longitudinally from the opening in said bag, said neck having a passage of the same diameter as the opening in said bag;

an annularly shaped plug located within said neck proximate to but not flush with the extended end of said neck;

an annularly shaped bushing located within said neck between said plug and the opening in said bag;

a check valve situated within said neck between said plug and said bushing and cooperating therewith such that said bushing functions as a valve seat, said check valve being normally urged into a closed position to prevent passage of liquid from said bag past said bushing but being displaceable to an open position to allow passage of liquid past said bushing when external pressure is applied to said bag, at least one of said check valve and said bushing is constructed of a vapor-permeable material;

a hollow tube, open at both ends, which is attached at one end within the aperture of said plug so that the passage of said tube is in fluid communication with the interior of said neck, said tube extending longitudinally from said plug and from said neck, said tube being sufficiently long, and its passage being sufficiently narrow, to retain liquid therein against tendency to flow therethrough by gravity alone;

a brush mounted tightly around the extended end of said tube such that said tube connects the interior of said neck with an interior portion of said brush; and a vapor-impermeable rigid cap which is removably fit over said brush and which is sufficiently long to engage the exterior of said neck in a friction-fit air-tight coupling thereby forming an air-tight enclosure about said brush.

3. An apparatus for storing and applying liquids to a surface comprising:

a flexible bag for storing and applying therefrom a liquid, said bag being permeable to vapor of the stored liquid and having a circular opening at one end, this end being inwardly tapered so that the opening is of smaller diameter than said bag;

a rigid hollow housing having a circular inlet opening and a smaller circular outlet opening, the openings being longitudinally coaxial to each other and to the opening in said bag;

a rigid cylindrically-shaped neck having an internal bore connecting the opening in said bag and the inlet opening in said housing, providing a leak-proof fluid passage between said bag and said housing;

a check valve situated within said housing, said valve normally being urged into a position such that the inlet opening of said housing is closed off to prevent passage of liquid from said bag through the inlet opening into said housing, said check valve being displaceable to an open position to allow passage of liquid through the inlet opening when external pressure is applied to said bag;

a hollow tube, open at both ends, attached at its upper end within the outlet opening of said housing so that the passage of said tube is in fluid communication with the interior of said housing, the passageway being sufficiently small to retain liquid in said housing against tendency to flow therefrom by gravity alone;

a brush mounted tightly around the lower end of said tube such that said tube connects the interior of said housing with an interior portion of said brush; and a rigid tubular sheath removably fitted over the portion of said apparatus containing said bag, and a rigid cap removably fitted over the portion of said apparatus containing said brush, said cap being sufficiently long to engage the open end of said sheath in a friction-fit air-tight coupling, forming an air-tight enclosure about said brush and said bag.

* * * * *